US009805834B2

(12) United States Patent
Koehler et al.

(10) Patent No.: US 9,805,834 B2
(45) Date of Patent: Oct. 31, 2017

(54) GRATING FOR PHASE-CONTRAST IMAGING

(75) Inventors: Thomas Koehler, Norderstedt (DE); Ewald Roessl, Ellerau (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1154 days.

(21) Appl. No.: 13/266,692

(22) PCT Filed: May 17, 2010

(86) PCT No.: PCT/IB2010/052168

§ 371 (c)(1),
(2), (4) Date: Oct. 27, 2011

(87) PCT Pub. No.: WO2010/134012

PCT Pub. Date: Nov. 25, 2010

(65) Prior Publication Data

US 2012/0057676 A1 Mar. 8, 2012

(30) Foreign Application Priority Data

May 19, 2009 (EP) ..... 09160672

(51) Int. Cl.
*G21K 1/06* (2006.01)

(52) U.S. Cl.
CPC ..... *G21K 1/06* (2013.01); *G21K 2207/005* (2013.01)

(58) Field of Classification Search
CPC .. G01N 23/00; G01N 23/20; G01N 23/20008; G01N 2223/00; G01N 2223/05;
(Continued)

(56) References Cited

U.S. PATENT DOCUMENTS

2005/0225860 A1* 10/2005 Mossberg et al. ..... 359/569
2005/0225861 A1* 10/2005 Mossberg et al. ..... 359/569
(Continued)

FOREIGN PATENT DOCUMENTS

DE 102006037281 A1 8/2007
DE 192996937281 A1 8/2007
(Continued)

OTHER PUBLICATIONS

Franz Pfeiffer, Timm Weitkamp, Oliver Bunk and Christian David; "Phase Retrieval and Differential Phase-Contrast Imaging with Low-Brilliance X-ray Sources", Nature Physics, Nature Publishing Group, Londong, GB LNKD-DOI: 10.1038/MPHYS265, Mar. 26, 2006, pp. 258-261, XP002422783. ISSN: 1745-2473.
(Continued)

*Primary Examiner* — Anastasia Midkiff

(57) ABSTRACT

The invention relates to gratings for X-ray differential phase-contrast imaging, a focus detector arrangement and X-ray system for generating phase-contrast images of an object and a method of phase-contrast imaging for examining an object of interest. In order to provide gratings with a high aspect ratio but low costs, a grating for X-ray differential phase-contrast imaging is proposed, comprising a first sub-grating (112), and at least a second sub-grating (114; 116; 118), wherein the sub-gratings each comprise a body structure (120) with bars (122) and gaps (124) being arranged periodically with a pitch (a), wherein the sub-gratings (112; 114; 116; 118) are arranged consecutively in the direction of the X-ray beam, and wherein the sub-gratings (112; 114; 116; 118) are positioned displaced to each other perpendicularly to the X-ray beam.

20 Claims, 9 Drawing Sheets

(58) Field of Classification Search
CPC ..... G01N 2223/056; G01N 2223/30; G01N 2223/40; A61B 6/48; A61B 6/484; G21K 1/00; G21K 1/06; G21K 1/062; G21K 1/067; G21K 1/10; G21K 2201/00; G21K 2201/06; G21K 2201/061; G21K 2201/067; G21K 2207/00; G21K 2207/005
USPC ..... 378/41, 62, 70–90, 145, 156–159, 204, 378/210
See application file for complete search history.

(56) References Cited

U.S. PATENT DOCUMENTS

2005/0231804 A1* 10/2005 Mossberg et al. ..... 359/563
2005/0237617 A1 10/2005 Carr et al.
2007/0183579 A1 8/2007 Baumann et al.
2007/0183582 A1* 8/2007 Baumann et al. ..... 378/145
2008/0317213 A1 12/2008 Hempel et al.
2009/0092227 A1* 4/2009 David et al. ..... 378/36
2010/0246764 A1* 9/2010 Itoh et al. ..... 378/62
2014/0226785 A1* 8/2014 Stutman et al. ..... 378/36

FOREIGN PATENT DOCUMENTS

WO 2004071298 A1 8/2004
WO 2009113725 A2 9/2009
WO 2009113726 A2 9/2009
WO 2009128550 A9 10/2009

OTHER PUBLICATIONS

Grunzweig et al, "Design, Fabrication, and Characterization of Diffraction Gratings for Neutron Phase Contrast Imaging", Review of Scientific Instruments, vol. 79, 2008.

* cited by examiner

GRATING FOR PHASE-CONTRAST IMAGING

FIELD OF THE INVENTION

The invention relates to gratings for X-ray differential phase-contrast imaging, a detector arrangement and X-ray system for generating phase-contrast images of an object and a method of phase-contrast imaging for examining an object of interest.

BACKGROUND OF THE INVENTION

Phase-contrast imaging with X-rays is used for example to enhance the contrast of low absorbing specimen compared to conventional amplitude contrast images. This allows to use less radiation applied to the object such as a patient. In order to be able to use the phase of a wave in relation with phase-contrast imaging the waves need to have a well-defined phase relation both in time and space. The temporal coherence can be provided by applying monochromatic X-ray radiation. Further, it is known to obtain X-rays with sufficient coherence from synchrotron sources. Since these methods are related to the disadvantage of higher costs and complexity, it is proposed in WO 2004/071298 A1 to provide an apparatus for generating a phase-contrast X-ray image comprising in an optical path an incoherent X-ray source, a first beam splitter grating, a second beam recombiner grating, an optical analyzer grating and an image detector. It has further recently been proposed to use higher X-ray energies in differential phase-contrast imaging (DPC). A severe obstacle in this translation is the production of phase gratings and absorption grating with high aspect ratios. If the Talbot distance of the first grating and thus the distance of the two gratings is kept constant, the aspect ratio R of the phase grating increases like $E^{3/2}$, where E is the X-ray energy. The term Talbot refers to that in case of a laterally periodic wave distribution due to a diffraction grating, an image is repeated at regular distances away from the grating plane which regular distance is called the Talbot Length. The limit in aspect ratio R of state-of-the-art fabrication of gratings, for example made from silicon, is currently in the range of 15 to 20, depending on many factors like pitch (in a region of a few microns), surface roughness etc. It has shown that the range of usable energies for differential phase-contrast imaging currently ends about 30-40 keV.

SUMMARY OF THE INVENTION

Hence, there may be a need to provide gratings with a high aspect ratio.

According to an exemplary embodiment of the invention, a grating for X-ray differential phase-contrast imaging is provided, which grating comprises a first sub-grating and at least a second sub-grating. The sub-gratings each comprise a body structure with bars and gaps being arranged periodically with a pitch. The sub-gratings are arranged consecutively in the direction of the X-ray beam. Further, the sub-gratings are positioned displaced to each other perpendicularly to the X-ray beam.

One of the advantages is that a grating is provided where the function is a combination of the sub-gratings. By distributing the function to a number of sub-gratings, the manufacture of the sub-gratings is facilitated.

In an exemplary embodiment the projections of the sub-gratings result in an effective grating with a smaller effective pitch than the pitches of the sub-gratings.

For example, in order to provide a grating with a determined effective pitch it is possible to provide two sub-gratings each sub-grating having a pitch with the double amount of the predetermined effective pitch of the grating. In other words, an equivalent grating consisting of only one grating would require much smaller gaps to provide the same aspect ratio as a grating according to the invention with a number of sub-gratings.

The aspect ratio is defined by the height/width ratio of the gaps. The combination of the sub-gratings results in a grating with an aspect ratio being an effective combination of the aspect ratios of the sub-gratings.

In an exemplary embodiment the sub-gratings have the same pitch.

Thereby it is possible to provide one type of sub-grating, in other words it is only necessary to produce or manufacture a single type of sub-grating which is then added in form of a first and at least a second sub-grating to form the inventive grating.

In a further exemplary embodiment, the pitch of one of the sub-gratings is a multiple of the pitch of another one of the sub-gratings.

This provides the possibility to manufacture different sub-gratings according to, for example, constructional or otherwise aspects.

For example, a first sub-grating with a medium pitch can be combined with a second and a third sub-grating having a larger pitch. The second and third gratings can have a pitch which is twice as large as the pitch of the first grating. In an example the first grating is arranged between the second and third grating formed a sort of sandwich. The effective grating has then an effective pitch which is for example half the amount of the pitch of the medium pitch of the first grating. Of course the second and third gratings are offset in relation both to each other and in relation to the pitch of the first grating.

In another exemplary embodiment, the sub-gratings have an equal bars/gap ratio.

In other words, the width of the gaps is the same as the width of the bars arranged in a row. For example, the bars/gap ratio (s/t) is about 1/1. This allows for an easy manufacturing process and provides for a positioning and displacement of the sub-gratings in relation to each other forming the inventive grating.

In a further exemplary embodiment the offset of the displacement is a fraction of the pitch.

In a further exemplary embodiment the offset of the displacement is half the pitch.

In a further exemplary embodiment the offset of the displacement is a fraction of half the pitch.

For example, a first and a second sub-grating having the same pitch and having a bars/gap ratio of 1/1 can be combined to form an effective grating with an effective pitch which is much smaller than the pitch of the sub-gratings.

In a further exemplary embodiment, the effective grating is defined by the sidewalls in direction of the X-ray beam. That means, the pitch is defined by the edges of the bar in form of the sidewalls defining the gap. This results in an effective pitch which is for example, starting with sub-gratings having an equal pitch with a gap/bar ratio of 1/1, the effective pitch being a quarter of the pitch of the first or second sub-grating.

For example, for sub-gratings with a bars/gap ratio (s/t) of about 1/1 the following results are given. In case the number of sub-gratings (n) is defined and the effective pitch, referenced by z, is also predetermined, the pitch of the sub-grating results from the following equation: a=2*n*z. Having thus prepared sub-gratings with calculated pitch, the two sub-gratings have to be positioned displaced to each other with the following offset: d=1/2 *1/n*a = z.

In a further exemplary embodiment, in cases where the bars/gap ratio (s/t) is smaller than 1, the following condition arises. In cases where the number of sub-gratings (n) and the effective pitch (z) is known and the width of the bars (s) equals the effective pitch (s=z), the pitch is as follows: a=2*n*z.

Further, the sub-gratings have to be positioned displaced to each other with the following offset: d=1/n*a=2*z.

Further, it is noted that having calculated the pitch and knowing the bar width being the same size as the effective pitch, it is possible to determine the width of the gap. In case the width of the gap is still meaning an obstacle for manufacturing the sub-gratings, the number of sub-gratings can be increased thereby increasing the pitch which also results in a larger gap width suitable for manufacturing.

In a further exemplary embodiment the height of each sub-grating creates a $\pi$ phase shift at the design wavelength.

This provides the advantage to ensure the correct phase shift of the wavelength suitable for phase-contrast images.

In a further exemplary embodiment, the design wavelength is predetermined according to the purpose of the apparatus where the gratings are applied.

In a further exemplary embodiment, the sub-gratings are arranged on a single wafer.

This allows an easy handling for further manufacturing and assembling steps. Another advantage is that the alignment takes place during manufacturing where a correct positioning is facilitated.

In an alternative exemplary embodiment, each sub-grating is arranged on an individual wafer.

This provides an easier manufacturing process and allows providing different types of gratings that can be combined according to individual needs.

In a further exemplary embodiment, the sub-gratings are made from silicon with an additional gold layer covering the bars and gaps. For example, such sub-gratings can be used for an absorption grating.

In a further exemplary embodiment, the gold layer is not applied in order to provide a phase grating.

According to an exemplary embodiment of the invention, a detector arrangement of an X-ray system for generating phase-contrast images of an object is provided comprising an X-ray source, a source grating, a phase grating, an analyzer grating and a detector, wherein the X-ray source is adapted to generate polychromatic spectrum of X-rays and wherein at least one of the gratings is a grating according to one of the preceding embodiments.

This provides a detector arrangement with gratings having small effective pitches but which gratings due to the fact that they are formed by a combination of at least two sub-gratings, wherein these sub-gratings can be manufactured with larger pitch gratings.

In an exemplary embodiment the detector arranegement is a focus detector arrangement.

Further, in an exemplary embodiment an X-ray system for generating phase-contrast data of an object is provided, which X-ray system comprises a detector arrangement of the preceding exemplary embodiment.

Still further, in an exemplary embodiment, a method of phase-contrast imaging for examining an object of interest is provided, the method comprising the following steps: Applying X-ray radiation beams of a conventional X-ray source to a source grating splitting the beams; applying the split beams to a phase grating recombining the split beams in an analyzer plane; applying the recombined beams to an analyzer grating; recording raw image data with a sensor while stepping the analyzer grating transversally over one period of the analyzer grating; and wherein at least one of the gratings is a grating of one of the preceding embodiments.

In an exemplary embodiment of the method, the source grating, the phase grating and the analyzer grating consist of a grating according to one of the preceding exemplary embodiments with a first sub-grating and at least a second sub-grating.

An advantage lies in the possibility to provide gratings with a small effective pitch but which gratings comprise sub-grating with larger pitches. In other words, gratings can be provided suitable for higher X-ray energies but which gratings are easier to manufacture because the gratings have pitches larger than the effective pitch.

According to another exemplary embodiment of the invention, a computer-readable medium is provided, in which a computer program for examination of an object of interest is stored which, when executed by a processor of an X-ray system, causes the system to carry out the above-mentioned method steps.

According to another exemplary embodiment of the invention, a program element for examination of an object of interest is provied which, when being executed by a processor of an X-ray system, causes the system to carry out the above-mentioned method steps.

BRIEF DESCRIPTION OF THE DRAWINGS

These and other aspects of the invention will be apparent from the exemplary embodiments described hereinafter with reference to the drawings.

DETAILED DESCRIPTION OF EXEMPLARY EMBODIMENTS

Figure 1:
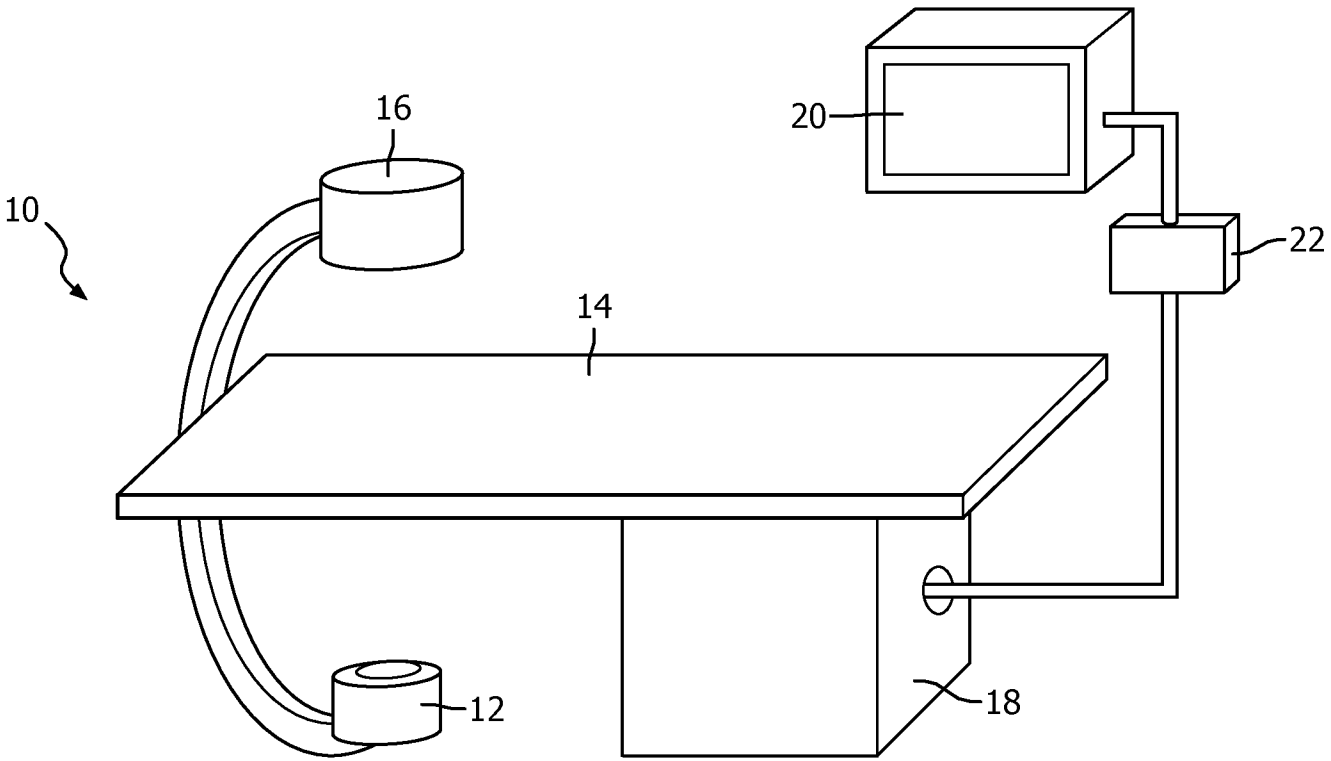
FIG. 1 schematically shows an example of an X-ray system.

FIG. 1 schematically shows an X-ray imaging system 10 with an examination apparatus for generating phase-contrast images of an object. The examination apparatus comprises an X-ray image acquisition device with a source of X-ray radiation 12 provided to generate X-ray radiation beams with a conventional X-ray source. A table 14 is provided to receive a subject to be examined. Further, an X-ray image detection module 16 is located opposite the source of X-ray radiation 12, i.e. during the radiation procedure the subject is located between the source of X-ray radiation 12 and the detection module 16. The latter is sending data to a data processing unit or calculation unit 18, which is connected to both the detection module 16 and the radiation source 12. The calculation unit 18 is located underneath the table 14 to save space within the examination room. Of course, it could also be located at a different place, such as a different laboratory.

Furthermore, a display device 20 is arranged in the vicinity of a table 14 to display information to the person operating the X-ray imaging system, which can be a clinician for example. Preferably, the display device is movably mounted to allow for an individual adjustment depending on the examination situation. Also, an interface unit 22 is arranged to input information by the user. Basically, the image detection module 16 generates image data by exposing the subject to X-ray radiation, wherein said image data is further processed in the data processing unit 18. It is noted that the example shown is of a so-called C-type X-ray image acquisition device. The X-ray image acquisition device comprises an arm in form of a C where the image detection module 16 is arranged at one end of the C-arm and the source of X-ray radiation 12 is located at the opposite end of the C-arm. The C-arm is movably mounted and can be rotated around the object of interest located on the table 14. In other words, it is possible to acquire images with different directions of view.

Figure 2:
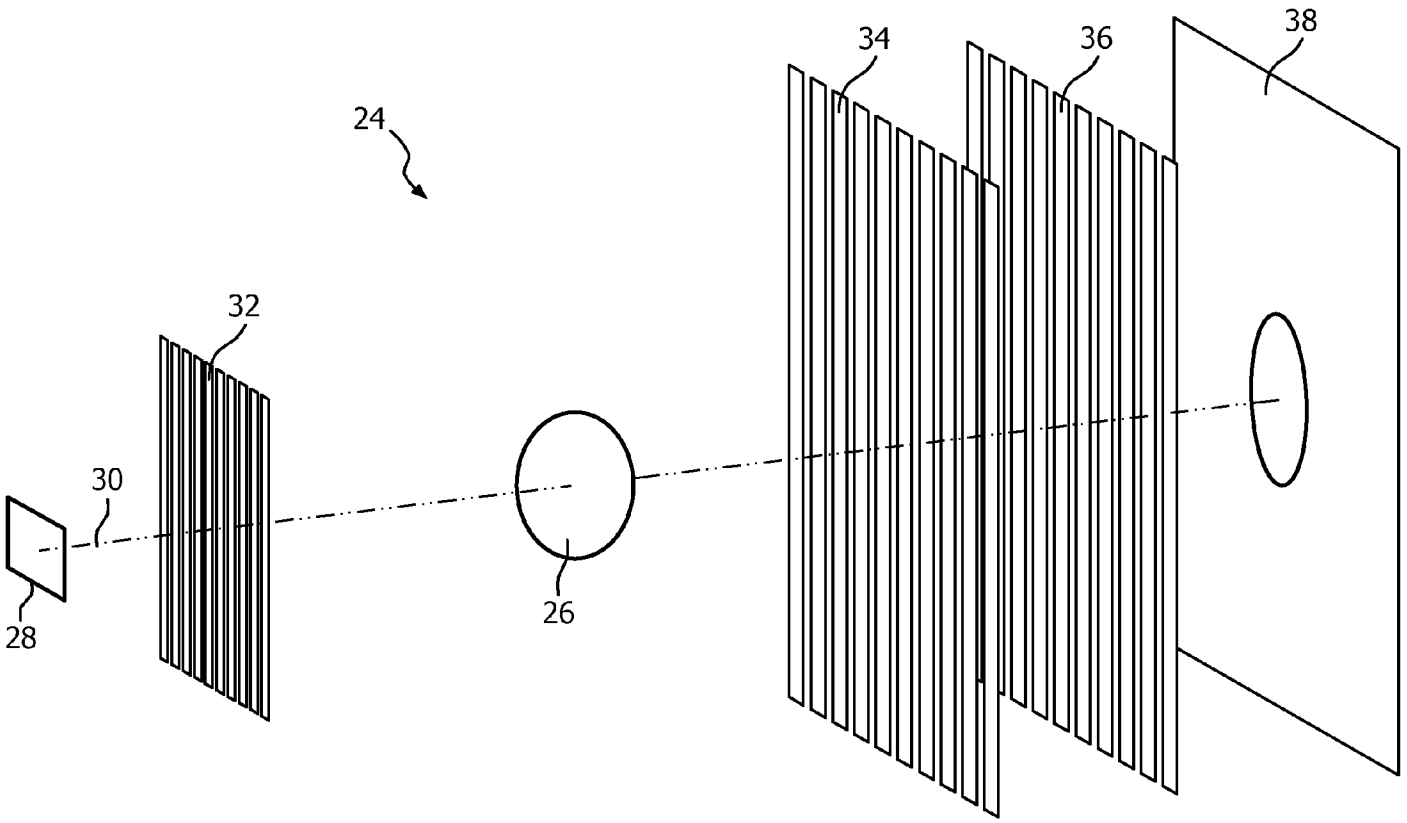
FIG. 2 schematically shows a detection arrangement of an X-ray system with different gratings.

FIG. 2 schematically shows a focus detector arrangement 24 of an X-ray system for generating phase-contrast images of an object 26. A conventional X-ray source 28 is provided applying X-ray radiation beams 30 to a source grating 32 splitting the beams 30. The splitted beams are then further applied to a phase grating 34 recombining the split beams in an analyzer plane. The object 26, for example a patient or a sample shown in FIG. 2, is arranged between the source grating 32 and the phase grating 34. After recombining the split beams behind the phase grating 34 the recombined beam 30 is applied to an analyzer grating 36. Finally a detector 38 is provided recording raw image data with a sensor while the analyzer grating 36 is stepped transversally over one period of the analyzer grating 36. The arrangement of at least one of the gratings 34, 36 comprising inventive sub-gratings is described in the following. It is noted that the sub-gratings according to the invention can also be applied to the source grating 32.

In FIGS. 3 to 9 different exemplary embodiments of a grating according to the invention are shown comprising at least two sub-gratings.

Figure 3:
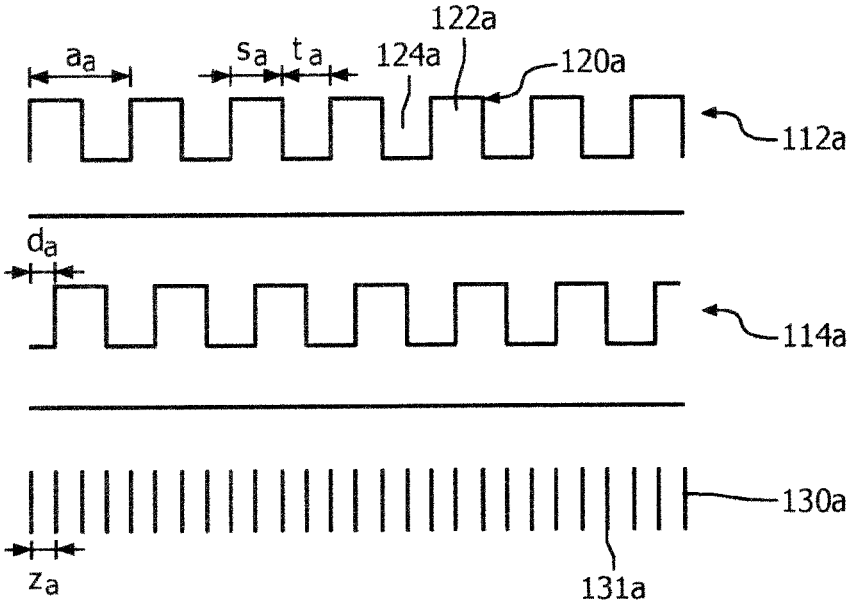
FIG. 3 schematically shows a first embodiment of a grating comprising two sub-gratings.

In FIG. 3 a first sub-grating 112*a* and a second sub-grating 114*a* are shown. The sub-gratings 112*a*, 114*a* each comprise a body structure 120*a* with bars 122*a* and gaps 124*a* being arranged periodically with a pitch $a_a$. The sub-grating 112*a*, 114*a* are arranged consecutively in the direction of the X-ray beam (not shown in FIGS. 3 to 9). For an easier understanding the sub-gratings are shown horizontally, whereas the sub-gratings in FIG. 2 are arranged vertically. Simply said, in FIGS. 3 to 17 the direction of the X-ray beam is from top of the page to the bottom of the page.

The sub-gratings 112*a*, 114*a* are positioned with a displacement $d_a$ in relation to each other in a perpendicularly direction to the X-ray beam. In other words, the sub-grating 114*a* is arranged in relation to the sub-grating 112*a* with the offset $d_a$ such that the sub-grating 114*a* is shifted towards the right in relation to sub-grating 112*a*.

The sub-gratings 112*a*, 114*a* of FIG. 3 have the same pitch $a_a$.

Further, the sub-gratings 112*a*, 114*a* have an equal bars/gap ratio ($s_a/t_a$). Hence, the width $s_a$ of a bar 122*a* is equal to the width $t_a$ of a gap 124*a*.

The displacement $d_a$ is a fraction of half the pitch $a_a$.

The projections of the sub-gratings 112*a*, 114*a* result in an effective grating 130*a* (depicted by lines 131*a*) with a smaller effective pitch $z_a$ than the pitch $a_a$ of the sub-gratings 112*a*, 114*a*. In FIG. 3 the displacement $d_a$ is equal to the effective pitch $z_a$.

In a further exemplary embodiment the grating comprises three sub-gratings 112*b*, 114*b*, 116*b*.

It is noted that similar features of the different exemplary embodiments have the same reference numeral added by a letter to indicate the different embodiments. For easier reading of the claims, the reference numbers in the claims are shown without the letter indizes.

Figure 4:
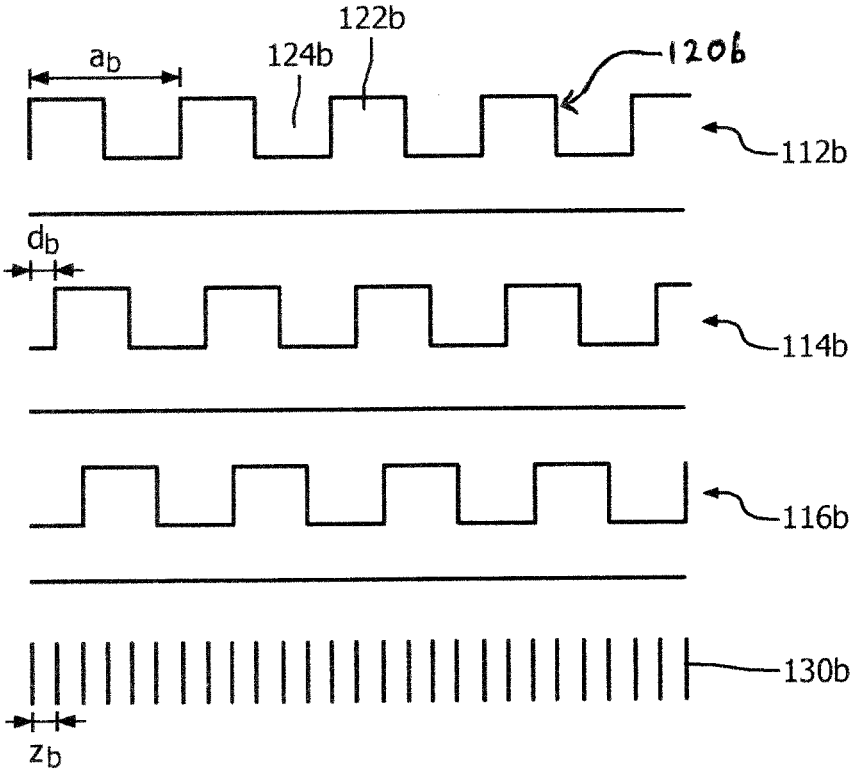
FIG. 4 schematically shows another embodiment with three sub-gratings.

The sub-gratings of FIG. 4 have the same pitch $a_b$. Here too, the bars/gap ratio ($s_b/t_b$) is 1/1.

The sub-gratings 112*b*, 114*b*, 116*b* also comprise a body structure 120*b* with bars 122*b* and gaps 124*b*. Although the gaps and the bars 124*b*, 122*b* have a larger width compared to the respective width of FIG. 3, an effective grating 130*b* is achieved with an effective pitch $z_b$ which is the same as the effective pitch $z_a$ of FIG. 3.

Figure 5:
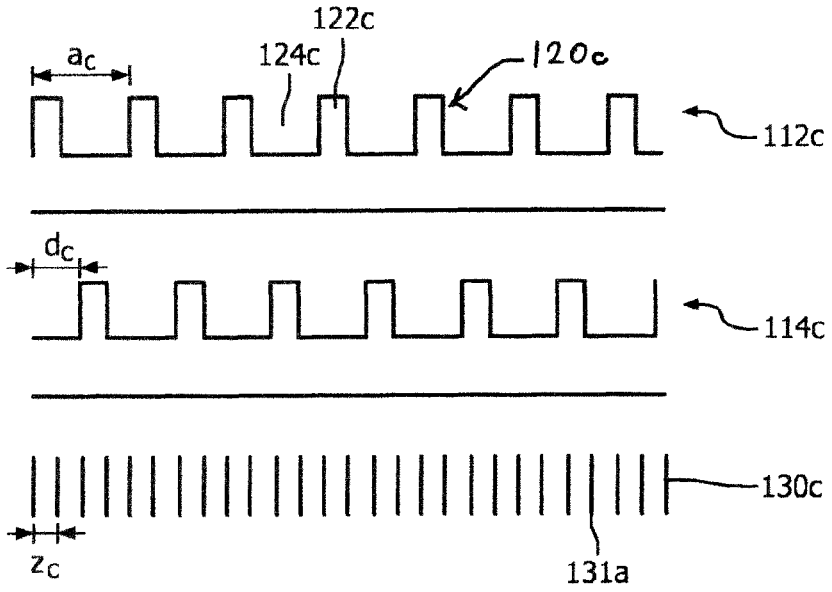
FIG. 5 schematically shows a further embodiment with two sub-gratings.

In FIG. 5 the grating comprises two sub-gratings 112*c* and 114*c*. The sub-gratings also comprise a body structure 120*c* with bars 122*c* and gaps 124*c*. The width of the gaps 124*c* is larger than the width of the bar 122*c*, hence the bars/gap ratio ($s_c/t_c$) is smaller than 1. The two sub-gratings 112*c* and 114*c* are arranged such that the effective grating 130*c* and the effective pitch $z_c$ is the same as in the figures discussed above. In FIG. 5 the width of the bars $s_c$ is equal to the effective pitch $z_c$. The width of the gap $t_c$ is 3 times the width of the bars $s_c$. The pitch $z_c$ of the sub-gratings which is the same for both sub-gratings can be calculated by the equation: $a=2*n*z$ where n is the number of sub-gratings and z is the effective pitch.

Figure 6:
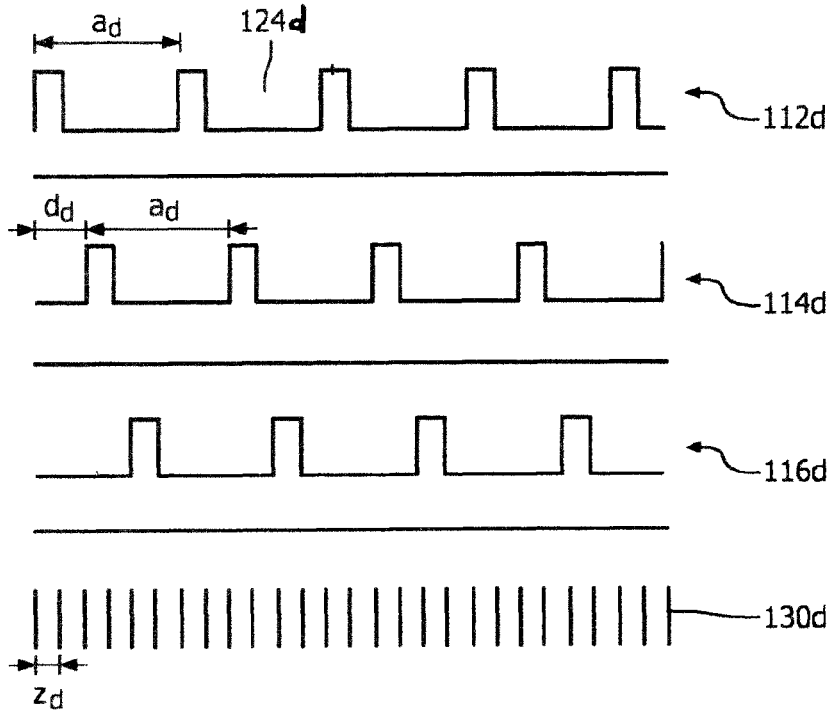
FIG. 6 schematically shows a further exemplary embodiment with three sub-gratings.

In a further exemplary embodiment, shown in. FIG. 6, three sub-gratings 112*d*, 114*d*, 116*d* are provided in a similar way as discussed above. The width of the gap 124*d* can be larger compared to the sub-gratings of FIG. 5, although the same effective grating 130*d* is provided due to the larger number of sub-gratings.

Figure 7:
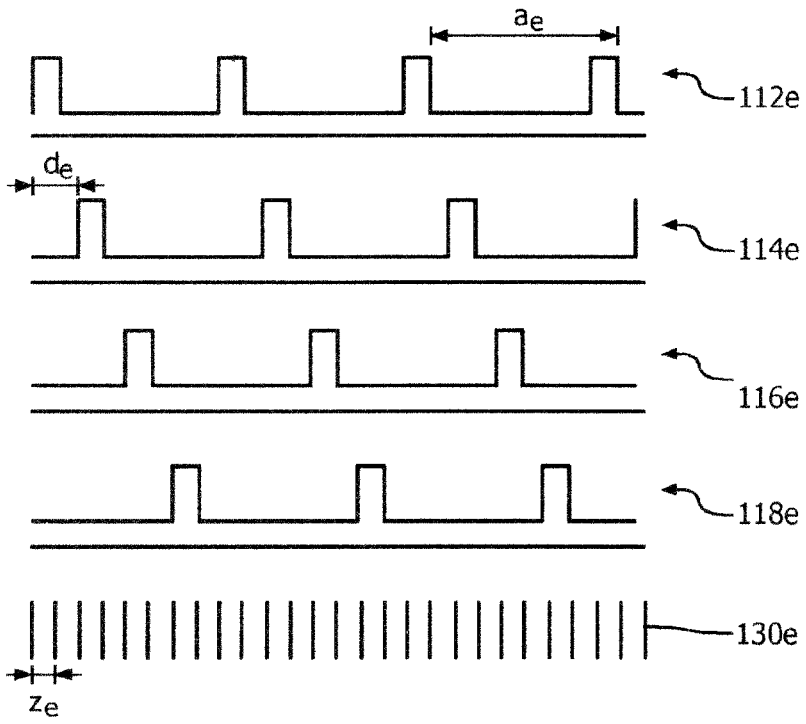
FIG. 7 schematically shows a further exemplary embodiment with four sub-gratings.

This is also shown in FIG. 7 where four sub-gratings 112*e*, 114*e*, 116*e* and 118*e* are shown. Here the sub-gratings have the same pitch $z_e$ and are arranged with an offset of: $d_e=2*z_e$;

$z_e$ being the effective pitch illustrated for a better understanding beneath each schematic description of the sub-gratings in relation with the effective grating 130*e*.

Figure 8:
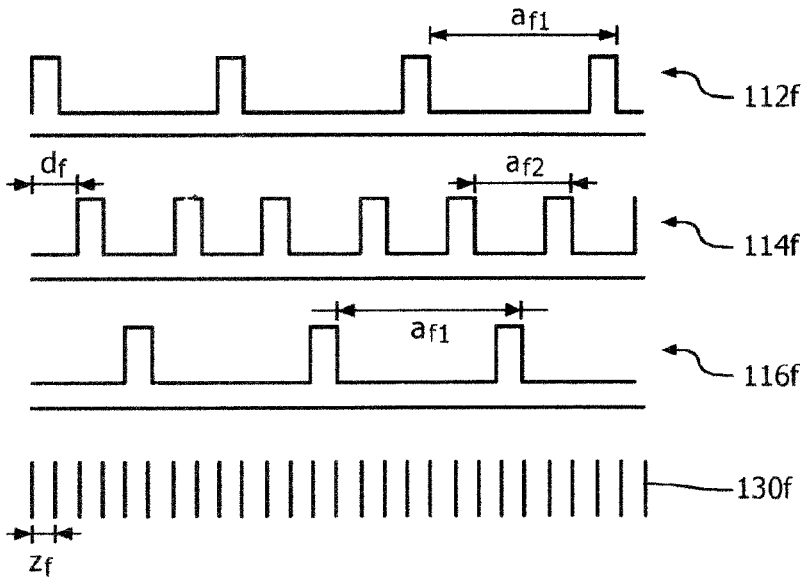
FIG. 8 schematically shows a further exemplary embodiment with three sub-gratings.

In a further exemplary embodiment in FIG. 8, three sub-gratings 112*f*, 114*f*, 116*f* are provided where one of the sub-gratings, in FIG. 8 the middle sub-grating 114*f*, is having a different pitch $a_{f2}$ compared to the pitch $a_{f1}$ of the other sub-gratings 112*f* and 116*f*. In fact, the pitch $a_{f1}$ of the first and third sub-gratings 112*f*, 116*f* is a multiple of the pitch $a_{f2}$ of the middle sub-grating 114*f*. In fact the ratio of the pitches of the sub-gratings is 1/2. Hence, the pitch $a_{f1}$ of the upper sub-grating 112*f* is twice the pitch $a_{f1}$ of the second sub-grating 114*f*. Here too, an effective 130*f* grating with an effective pitch similar to the embodiment discussed above is achieved.

Figure 9:
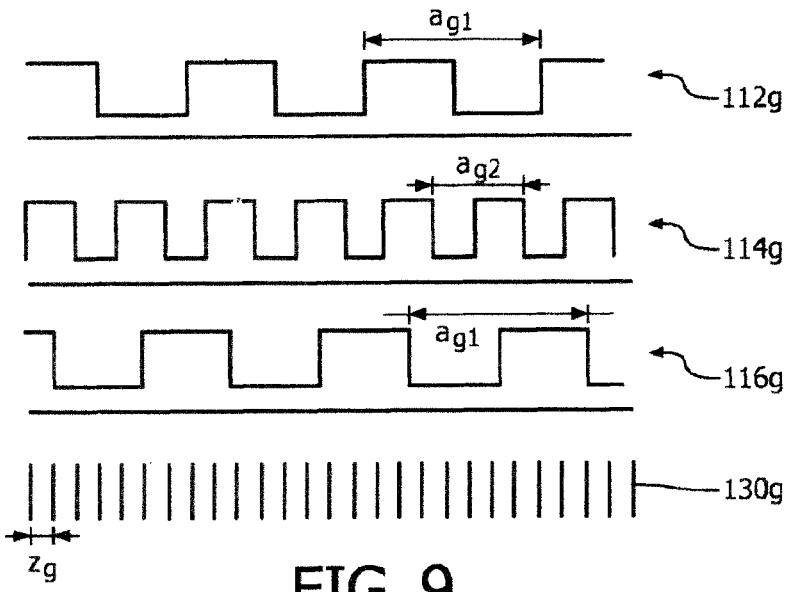
FIG. 9 schematically shows a further exemplary embodiment with three sub-gratings.

Whereas in FIG. 8 the width of the bars of all three sub-gratings is having the same size, in a further exemplary embodiment shown in FIG. 9 the width of the bars of the sub-gratings is different. In FIG. 9 three sub-gratings 112*g*, 114*g* and 116*g* are arranged such that the middle sub-grating 114*g* is having a pitch $a_{g2}$ which is half the amount of a pitch $a_{g1}$ of the upper and lower sub-gratings 112*g*, 116*g*. The three sub-gratings are offset to each other such that the effective grating 130*g* with an effective pitch, shown underneath by lines, is the same as the effective pitches of the embodiments discussed above.

Providing sub-gratings which are arranged with an offset to each other allows an easier manufacturing of the sub-gratings because the gaps that are, for example, etched into the body structure's substance are wider and thus easier to apply during manufacture. However, the projections of the sub-gratings result in an effective grating with an effective pitch which is smaller than the pitches of the sub-gratings.

Figure 10:
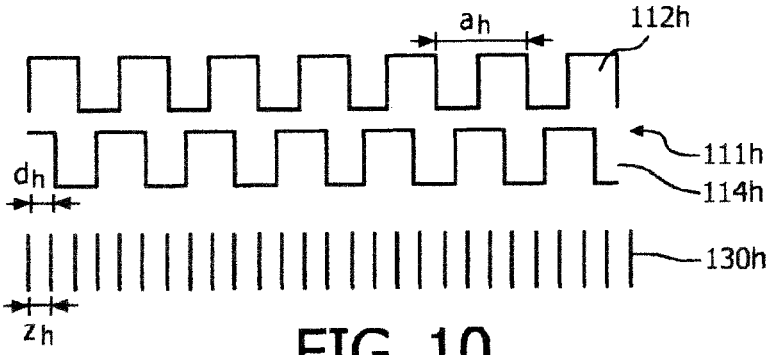
FIG. 10 schematically shows a further exemplary embodiment with two sub-gratings arranged on a single wafer.

In a further exemplary embodiment the sub-gratings 112*h*, 114*h* are arranged on a single wafer 111*h*, shown in FIG. 10. Here two sub-gratings are provided with offset pitches $a_h$ by offset $d_h$ and effective pitch $z_h$, shown in FIG.10 on the effective grating 130*h*.

Figure 11:
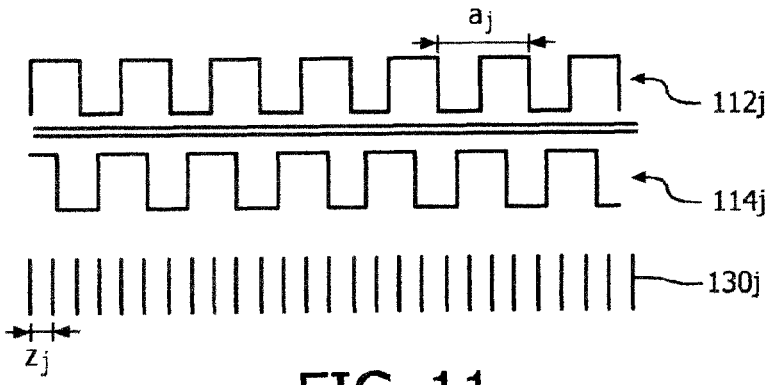
FIG. 11 schematically shows a further exemplary embodiment with two sub-gratings; p FIG. 12 schematically shows the arrangement of FIG. 2 as a phase grating for a detector arrangement of an X-ray system.

In a further exemplary embodiment, two sub-gratings 112*j*, 114*j* having a pitch $a_j$ are configured such that they are arrangeable with their closed sides or flat sides 116*j*, 118*j* adjacent to each other (FIG. 11). This provides the advantage that two individual sub-gratings 112*j*, 114*j* can be manufactured which are then attached to each other so that no further positioning or alignment steps of the two sub-gratings in relation to each other are necessary. An effective grating 130*j* of smaller pitch $z_j$ results.

Figure 12:
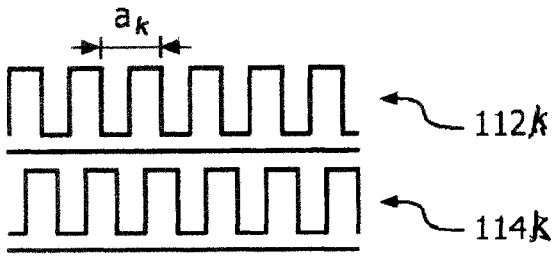
Figure 14:
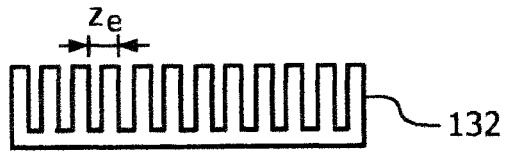
FIG. 14 shows an equivalent single grating for the two sub-gratings of FIG. 12 and FIG. 13.

In FIG. 12 a grating for a phase grating is shown comprising two sub-gratings 112*k* and 114*k*. The sub-gratings 112*k*, 114*k* each have the same pitch and the bars/gap ratio, i.e. s/t=1/1. FIG. 14 shows the equivalent grating 132 when providing only a single grating in order to achieve the same pitch as the effective pitch of the two sub-gratings 112*k*, 114*k*. It can be seen that the pitch $a_k$ of the sub-gratings is larger than the pitch $z_e$ of the equivalent grating 132.

Figure 13:
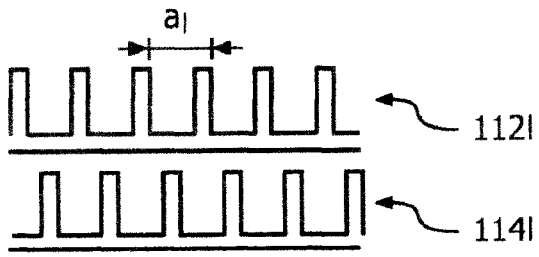
FIG. 13 schematically shows the arrangement of FIG. 5 as a phase grating for a detector arrangement of an X-ray system.

The same effective grating with the same effective pitch can also be achieved by providing two sub-gratings 1121, 1141 for a phase grating having the same pitch $a_1$ but in contrary to the sub-gratings of FIG. 12, the bars/gap ratio (s/t) is smaller 1, in the exemplary embodiment in FIG. 13 the bars/gap ratio is 1/3. The equivalent is the same as for FIG. 12 (see FIG. 14).

Figure 15:
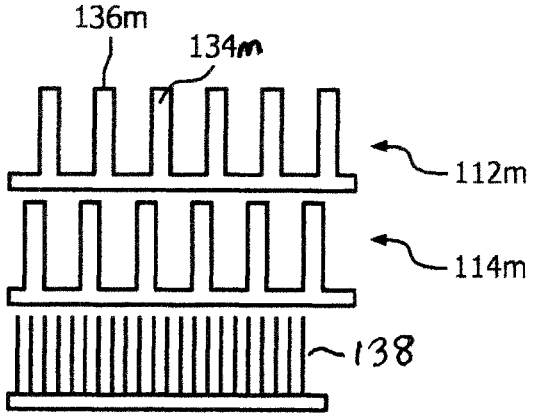
FIG. 15 schematically shows the arrangement of FIG. 2 as an absorption grating for a detector arrangement.
Figure 16:
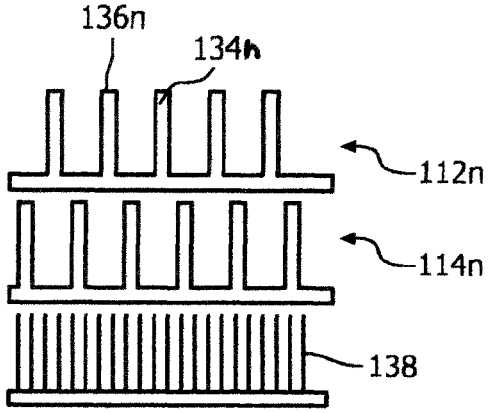
FIG. 16 schematically shows the arrangement of FIG. 5 as an absorption grating for a detector arrangement.

In FIGS. 15 and 16 a similar arrangement is provided for an absorption grating with high aspect ratio. In FIG. 15 two sub-gratings 112*m*, 114*m* having the same pitch are shown with a bars/gap ratio of 1/1; whereas, in FIG. 16 two sub-gratings 112*n*, 114*n* have a bars/gap ratio that is smaller than 1. The sub-gratings 112*m*, 114*m*, 112*n*, 114*n* respectively comprise silicon body structures 134*m* and 134*n* with an additional corresponding gold layer 136*m*, 136*n*. The results in an effective gold granting 138 shown underneath each pair of the sub-grantings 112*m*, 114*m*, 112*n*, 114*n* for illustrative purposes.

Figure 17:
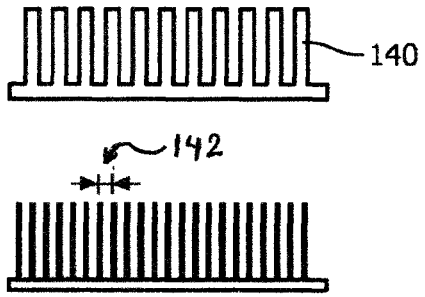
FIG. 17 shows an equivalent single grating for the two sub-gratings of FIG. 15 and FIG. 16.

FIG. 17 shows the equivalent grating 140 when providing only a single grating and the resulting pitch 142 due to the gold layer. It can be seen that in order to provide a grating with a high aspect ratio, a grating has to be provided with smaller gaps to provide the same effective grating as the combination of two sub-gratings shown in FIGS. 12, 13, 15 and 16. Hence, compared to the equivalent single gratings shown in FIGS. 14 and 17, the sub-gratings according to the invention can be manufactured in an easier and thus cheaper and more economic way.

The sub-gratings can be used instead of single gratings, for example in phase-contrast X-ray imaging.

Figure 18:
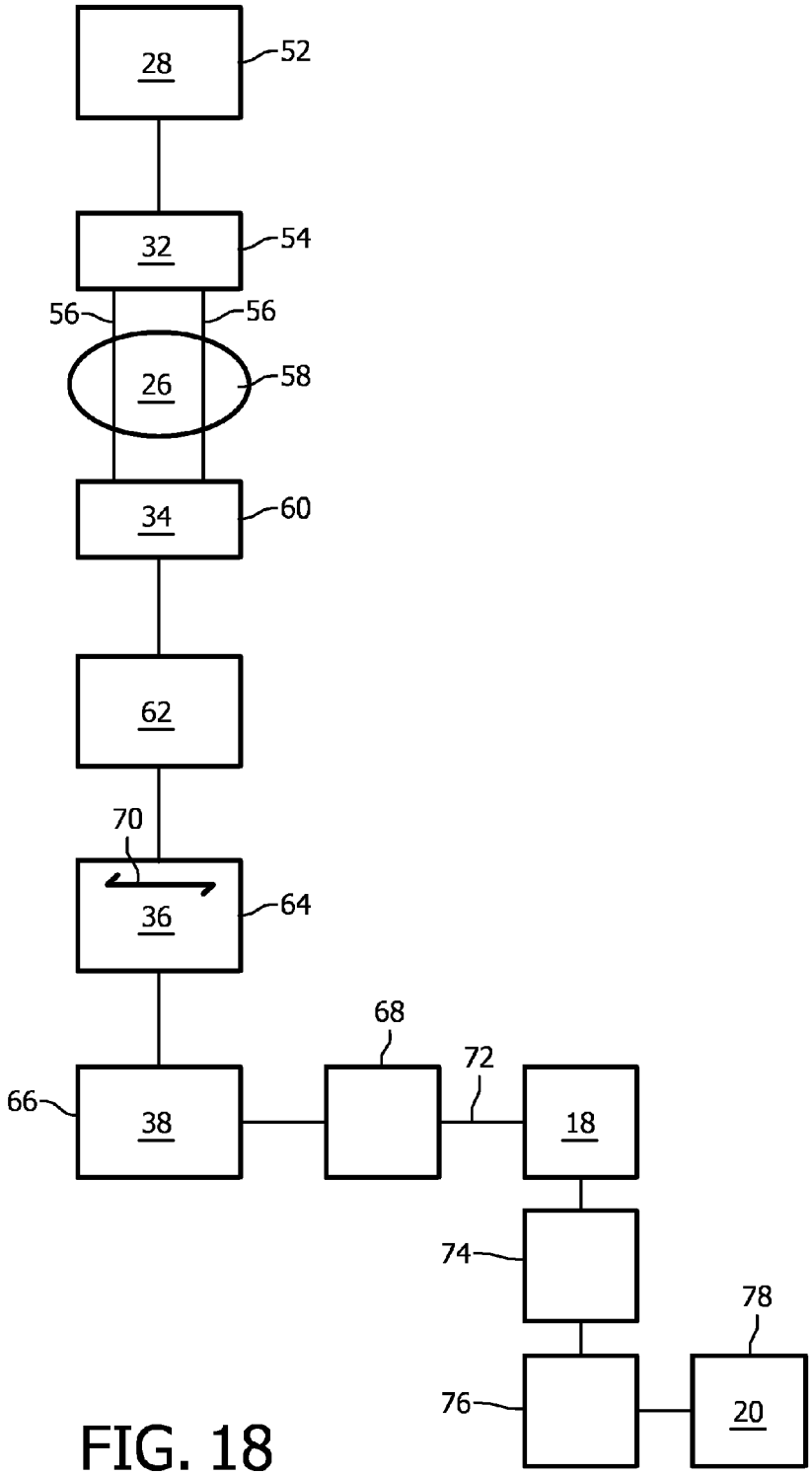
FIG. 18 shows a method for generating phase-contrast X-ray images of according to the invention.

The steps of an exemplary embodiment of a method are shown in FIG. 18. In a first step X-ray radiation beams of a conventional X-ray source 28 are applied 52 to a source-grating 32 where the beams are splitted 54. The source grating 32 comprises two sub-gratings (not shown in FIG. 18) arranged consecutively in the direction of the X-ray beam and positioned displaced to each other perpendicularly to the X-ray beam.

The splitted beams are then transmitted 56 towards an object of interest 26, wherein the beams are passing through the object 26 where adsorption and refraction 58 occurs. The beams are further applied to a phase grating 34 where the splitted beams are recombined 60 in an analyser plane 62. Also, the phase grating 34 comprises two sub-gratings (not shown in FIG. 18). Then, the recombined beams are applied 64 to an analyzer grating 36 also comprising two sub-gratings (not shown in FIG. 18). Further, a sensor 38 is recording 66 raw image data 68 while the analyzer grating 36 is stepped transversely 70 over one period of the analyzer grating. Finally, the raw data 68 is transmitted 72 to a control unit 18 where the data is computed 74 into display data 76 to show 78 images on a display 20.

While the invention has been illustrated and described in detail in the drawings and foregoing description, such illustration and description are to be considered illustrative or exemplary and not restrictive; the invention is not limited to the disclosed embodiments.

It should be noted that the term "comprising" does not exclude elements or steps and the "a" or "an" does not exclude a plurality. Also, elements described in association with different embodiments may be combined.

The invention claimed is:

1. A grating for X-ray differential phase-contrast imaging, comprising:

a first sub-grating; and at least a second sub-grating, the sub-gratings each comprising a body structure with bars, and gaps, arranged periodically with a pitch, said sub-gratings being arranged consecutively for receiving an X-ray beam and being positioned laterally displaced from each other, said grating being configured as one of a phase grating, an analyzer grating, and an absorption grating.

2. The grating of claim 1, projections of said sub-gratings resulting in an effective grating with a smaller effective pitch than the pitches of said sub-gratings.

3. The grating of claim 1, said sub-gratings having the same pitch.

4. The grating of claim 3, wherein the displacement of one of said sub-gratings from another one of said sub-gratings is an offset amounting to a fraction of half the pitch.

5. The grating of claim 1, wherein the sub-gratings have an equal bars/gap ratio.

6. A grating for X-ray differential phase-contrast imaging, comprising:

a first sub-grating; and at least a second sub-grating, the sub-gratings each comprising a body structure with bars, and gaps, arranged periodically with a pitch, said sub-gratings being arranged consecutively for receiving an X-ray beam and being positioned laterally displaced from each other, wherein the pitch of one of said sub-gratings is a multiple of the pitch of another one of said sub-gratings.

7. A grating for X-ray differential phase-contrast imaging, comprising:

a first sub-grating; and at least a second sub-grating, the sub-gratings each comprising a body structure with bars, and gaps, arranged periodically with a pitch, said sub-gratings being arranged consecutively for receiving an X-ray beam and being positioned laterally displaced from each other, wherein said sub-gratings each has a height that creates a $\pi$-phase shift at a design wavelength.

8. A grating for X-ray differential phase-contrast imaging, comprising:

a first sub-grating; and at least a second sub-grating, the sub-gratings each comprising a body structure with bars, and gaps, arranged periodically with a pitch, said sub-gratings being arranged consecutively for receiving an X-ray beam and being positioned laterally displaced from each other, said sub-gratings being arranged on a single wafer.

9. A detector arrangement of an X-ray system for generating phase-contrast images of an object, said arrangement comprising:

an X-ray source;

a source grating;

a phase grating;

an analyzer grating; and a detector, wherein the X-ray source is adapted to generate polychromatic spectrum of X-rays; and wherein at least one of the phase and analyzer gratings is a grating according to claim 1.

10. An X-ray system for generating phase-contrast data of an object, said system comprising the detector arrangement of claim 9.

11. A method of phase-contrast imaging for examining an object of interest, comprising:

applying X-ray radiation beams of an X-ray source to a source-grating splitting the beams;

applying the splitted beams to a phase grating recombining the splitted beams in an analyzer plane;

applying the recombined beams to an analyzer grating; and recording raw image data with a sensor while stepping the analyzer grating transversely over one period of the analyzer grating, wherein at least one of the phase and analyzer gratings is a grating according to claim 1.

12. A non-transitory computer-readable medium embodying a computer program for examination of an object of interest via phase-contrast imaging, said program having instructions executable by a processor of an X-ray system for causing the system to carry out a plurality of acts, among said plurality there being the acts of:

applying (52) X-ray radiation beams of an X-ray source to a source-grating splitting the beams;

applying the splitted beams to a phase grating recombining the splitted beams in an analyzer plane;

applying the recombined beams to an analyzer grating; and recording raw image data with a sensor while stepping the analyzer grating transversely over one period of the analyzer grating;

wherein at least one of the phase and analyzer gratings is a grating according to claim 1.

13. The grating of claim 1, said sub-gratings having respective front surfaces and being arranged so that said surfaces are disposed normal to said beam and face in a direction of arrival of said beam.

14. The grating of claim 1, a given sub-grating from among said sub-gratings comprising silicon, and an additional gold layer covering said bars, and said gaps, of the body structure of said given sub-grating.

15. The grating of claim 2, said effective grating being defined by sidewalls in a propagation direction of an X-ray beam, in which direction said sub-gratings face.

16. The grating of claim 15, a given sub-grating from among said sub-gratings comprising silicon, and an additional gold layer covering said bars, and said gaps, of the body structure of said given sub-grating.

17. The computer readable medium of claim 12, among said plurality of acts there being a further act of computing the recorded raw image data into display data.

18. The grating of claim 1, said sub-gratings facing in a same direction.

19. The grating of claim 18, the displacement being normal to said direction.

20. The grating of claim 18, the respective displacements of each of said sub-gratings from the other one or more of said sub-gratings being normal to said direction.

* * * * *